US010920645B2

(12) United States Patent
Yoo et al.

(10) Patent No.: US 10,920,645 B2
(45) Date of Patent: Feb. 16, 2021

(54) SYSTEMS AND METHODS FOR ON-BOARD MONITORING OF A PASSIVE NOX ADSORPTION CATALYST

(71) Applicant: Ford Global Technologies, LLC, Dearborn, MI (US)

(72) Inventors: In Kwang Yoo, Ann Arbor, MI (US); Michiel Van Nieuwstadt, Ann Arbor, MI (US); Douglas Allen Dobson, Ypsilanti, MI (US); Christine Lambert, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 266 days.

(21) Appl. No.: 16/053,557

(22) Filed: Aug. 2, 2018

(65) Prior Publication Data

US 2020/0040796 A1 Feb. 6, 2020

(51) Int. Cl.

| | |
|---|---|
| ***F01N 11/00*** | (2006.01) |
| ***F02M 26/00*** | (2016.01) |
| ***F02D 35/00*** | (2006.01) |
| ***F02D 41/40*** | (2006.01) |

(Continued)

(52) U.S. Cl.

CPC ..... *F01N 11/00* (2013.01); *F02D 35/0092* (2013.01); *F02D 41/401* (2013.01); *F02D 41/402* (2013.01); *F02M 26/00* (2016.02); *F01N 3/0842* (2013.01); *F01N 3/2066* (2013.01); *F01N 2550/03* (2013.01); *F01N 2900/08* (2013.01); *F01N 2900/1404* (2013.01);

(Continued)

(58) Field of Classification Search

CPC ..... F02D 2200/0802; F02D 2200/0806; F02D 2200/0808; F02D 2200/0811; F02D 41/0235; F02D 41/1446; F02D 41/1463; F02D 41/145; F01N 3/0814; F01N 3/0842; F01N 3/2066; F01N 11/00; F01N 13/009; F01N 2550/03; F01N 2560/026; F01N 2560/06; F01N 2570/14; F01N 2900/1614

See application file for complete search history.

(56) References Cited

U.S. PATENT DOCUMENTS 5,201,802 A * 4/1993 Hirota ..... F01N 3/2006 60/276
6,216,448 B1 4/2001 Schnaibel et al.
6,216,451 B1 4/2001 Schnaibel et al.
(Continued)

FOREIGN PATENT DOCUMENTS

WO 9961770 A1 12/1999

*Primary Examiner* — John M Zaleskas
(74) *Attorney, Agent, or Firm* — Geoffrey Brumbaugh; McCoy Russell LLP

(57) ABSTRACT

Methods and systems are provided for monitoring a NOx storage capacity of a passive NOx adsorption catalyst (PNA) included in an exhaust gas after-treatment system of an engine. In one example, a method may include, after an engine cold start and prior to an exhaust gas temperature reaching an upper threshold temperature, indicating degradation of the PNA based on an amount of NOx measured downstream of the PNA during a fuel cut event and while the exhaust gas temperature is between a lower threshold temperature and the upper threshold temperature. In this way, degradation of the NOx storage capacity may be inferred based on an amount of NOx released from the PNA and independent of a NOx storage measurement.

19 Claims, 4 Drawing Sheets

(51) Int. Cl.
*F01N 3/08* (2006.01)
*F01N 3/20* (2006.01)

(52) U.S. Cl.
CPC .. *F01N 2900/1622* (2013.01); *F02D 2200/08* (2013.01); *F02M 2026/001* (2016.02)

(56) References Cited

U.S. PATENT DOCUMENTS 6,347,513 B2 2/2002 Pfleger et al.
6,385,966 B2 5/2002 Zhang
6,389,802 B1 5/2002 Berger et al.
6,449,291 B1 9/2002 Burns et al.
6,519,930 B1 2/2003 Maus et al.
6,619,108 B2 9/2003 Birkhofer et al.
6,622,476 B2 9/2003 Sumilla et al.
6,632,764 B2 10/2003 Drückhammer et al.
6,637,190 B1 10/2003 Pott
6,705,078 B2 3/2004 Hahn et al.
6,823,657 B1 11/2004 Waschatz et al.
6,826,902 B2 12/2004 Sun et al.
6,852,292 B2 2/2005 Berriman et al.
6,871,492 B2 3/2005 Huynh et al.
6,889,497 B2 5/2005 Schnaibel et al.
6,901,745 B2 6/2005 Schnaibel et al.
6,928,808 B2 8/2005 Hahn et al.
6,941,748 B2 9/2005 Pott et al.
6,956,008 B2 10/2005 Takeshima et al.
7,383,680 B2 6/2008 Odendall
8,022,010 B2 9/2011 Hilgendorff et al.
8,592,337 B2 11/2013 Hilgendorff et al.
8,734,743 B2 5/2014 Müller-Stach et al.
8,735,318 B2 5/2014 Nam et al.
8,784,759 B2 7/2014 Hilgendorff
8,813,478 B2 8/2014 Gonze et al.
8,984,870 B2 3/2015 Schmieg et al.
9,180,432 B2 11/2015 Nam et al.
9,482,128 B2 11/2016 Eckhoff et al.
9,498,775 B2 11/2016 Zheng et al.
9,540,980 B2 1/2017 Hilgendorff
9,597,635 B2 3/2017 Qi et al.
9,616,386 B2 4/2017 Hatanaka et al.
2001/0054282 A1* 12/2001 Lang ..... F02D 41/0275 60/277
2004/0000135 A1* 1/2004 Uchida ..... F02D 41/1495 60/277
2004/0103650 A1* 6/2004 Miyashita ..... F02D 41/0275 60/285
2005/0144933 A1* 7/2005 Enoki ..... B01D 53/9495 60/277
2006/0016178 A1* 1/2006 Audoin ..... F01N 11/007 60/295
2006/0236678 A1* 10/2006 Tanada ..... F01N 3/0835 60/277
2006/0242945 A1* 11/2006 Wang ..... F02D 41/0275 60/277
2007/0051094 A1* 3/2007 Tanada ..... F01N 13/0097 60/277
2008/0148804 A1* 6/2008 Yezerets ..... F02D 41/028 73/1.01
2010/0287918 A1 11/2010 Kuwajima
2011/0023590 A1* 2/2011 Van Nieuwstadt ..... F02D 41/1447 73/114.73
2012/0053816 A1* 3/2012 Odendall ..... F02D 41/123 701/102
2012/0090297 A1* 4/2012 Yacoub ..... F01N 3/0842 60/274
2012/0137663 A1* 6/2012 Lee ..... F01N 3/0842 60/287
2013/0297192 A1* 11/2013 Imeroski ..... F02D 41/22 701/112
2015/0273452 A1 10/2015 Chiffey et al.
2015/0377102 A1* 12/2015 Yezerets ..... F01N 3/2066 60/274
2016/0084185 A1* 3/2016 Theis ..... F02D 41/064 701/105
2016/0341091 A1* 11/2016 Theis ..... F01N 3/0842
2017/0328294 A1* 11/2017 Poloni ..... F02D 41/1454
2018/0100417 A1* 4/2018 Choung ..... F01N 3/2033
2018/0274427 A1* 9/2018 Nishijima ..... B01D 53/9422
2018/0340459 A1* 11/2018 Nobukawa ..... F01N 3/0814
2019/0024564 A1* 1/2019 Takaoka ..... F01N 9/00
2019/0078490 A1* 3/2019 Lee ..... F01N 3/101
2019/0234281 A1* 8/2019 Wiebenga ..... F01N 13/009

* cited by examiner

SYSTEMS AND METHODS FOR ON-BOARD MONITORING OF A PASSIVE NOX ADSORPTION CATALYST

FIELD

The present description relates generally to systems and methods for reducing nitrogen oxide emissions of a vehicle engine.

BACKGROUND/SUMMARY

Nitrogen oxides such as NO and $NO_2$, referred to collectively as NOx, are common constituents of engine exhaust gas, particularly of diesel engines. An amount of NOx emitted by the engine may be controlled to meet vehicle emissions standards via an exhaust after-treatment system. For example, NOx may be reduced to nitrogen gas at a selective catalytic reduction catalyst (SCR catalyst) included in the exhaust after-treatment system. However, the SCR catalyst must first heat up and achieve light-off before being able to reduce NOx. An amount of time before the SCR catalyst reaches light-off may be prolonged during cold starts, light acceleration, and low speed-load cruises. Therefore, a passive NOx adsorption catalyst (PNA, also called a passive NOx adsorber or a cold start catalyst) may be further included in the exhaust after-treatment system upstream of the SCR catalyst. The PNA stores and releases NOx in a temperature-dependent manner such that NOx is stored at lower exhaust gas temperatures and released at higher exhaust gas temperatures. For example, during cold starts, the PNA may store NOx in the engine exhaust gas. Then, as the exhaust gas temperature increases and the SCR catalyst reaches light-off, the PNA may release the stored NOx, which may be reduced by the downstream SCR catalyst. However, if a NOx storage capacity of the PNA becomes degraded, NOx may flow to the SCR catalyst before it is active, resulting in increased NOx emissions. Methods that enable the NOx storage capacity of the PNA to be monitored so that PNAs with a degraded NOx storage capacity can be quickly identified (and therefore repaired or replaced) may reduce vehicle NOx emissions.

Other attempts to monitor a NOx storage capacity of an exhaust after-treatment system component include using two NOx sensors, one upstream of the exhaust after-treatment system component and one downstream of the exhaust after-treatment system component, to determine NOx input into the component versus NOx output of the component, respectively. One example approach is shown by Lang et al. in U.S. Pat. No. 6,499,291. Therein, a NOx content of exhaust gas upstream and downstream of a NOx storage catalytic converter is used to determine a storage efficiency. The NOx content downstream is measured by a NOx sensor, and the NOx content upstream is either measured by an additional NOx sensor or modeled based on engine operating parameters. The storage efficiency is then compared to a threshold to determine if the NOx storage catalytic converter is faulty.

However, the inventors herein have recognized that NOx storage may be monitored via NOx release alone, as there will be no release of NOx without NOx storage. Furthermore, by monitoring NOx release independent of current NOx input, the upstream NOx sensor may be omitted, reducing vehicle costs and potential points of degradation. Further still, modeling an amount of NOx emitted by the engine may be inaccurate, which may decrease an accuracy of a diagnostic that relies on the model for differentiating between a degraded and a non-degraded NOx storage capacity.

In one example, the issues described above may be addressed by a method comprising: indicating degradation of a passive NOx adsorption catalyst (PNA) based on an amount of nitrogen oxides (NOx) measured downstream of the PNA during an overrun event that occurs after an exhaust gas temperature measured upstream of the PNA reaches a lower threshold temperature and while a modeled stored NOx value is greater than a lower threshold. In this way, the PNA may be checked for degradation via a diagnostic that uses NOx release from the PNA alone, reducing vehicle costs and complexity by omitting an upstream NOx sensor.

As one example, the amount of NOx measured downstream of the PNA during the overrun event may be measured during a condition that facilitates a release of stored NOx from the PNA. For example, the condition may include an exhaust gas temperature measured upstream of PNA being within a threshold temperature range defined by the lower threshold temperature and an upper threshold temperature. The PNA may begin to release NOx at exhaust gas temperatures slightly below the lower threshold temperature, ensuring that NOx is being released by the time the lower threshold temperature is reached, whereas at exhaust gas temperatures above the upper threshold temperature, any stored NOx may have already been released. Further, the condition may include an indication that sufficient NOx has been stored prior to the release, such as while the modeled stored NOx value is greater than the lower threshold.

As another example, the amount of NOx measured downstream of the PNA during the overrun event may be an average NOx value from a plurality of NOx measurements made by a NOx sensor coupled downstream of the PNA after a delay during the overrun event. The overrun event may include operating the engine in a fuel-cut condition, where fuel injection to the engine is stopped while the engine remains on, such as in response to a vehicle deceleration condition. In response to the average NOx value being less than a threshold NOx value, a controller may indicate degradation of the PNA. In response to indicating degradation of the PNA, one or more operating parameters of the engine may be adjusted upon a subsequent engine cold start in order to minimize an amount of NOx emitted prior to the PNA being repaired or replaced. In this way, degradation of the PNA may be accurately diagnosed in a timely fashion, reducing vehicle NOx emissions. Furthermore, the threshold NOx value for distinguishing degradation of the PNA is independent of a potentially inaccurate model of an amount of NOx produced by the engine, thereby increasing an accuracy of the diagnostic.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
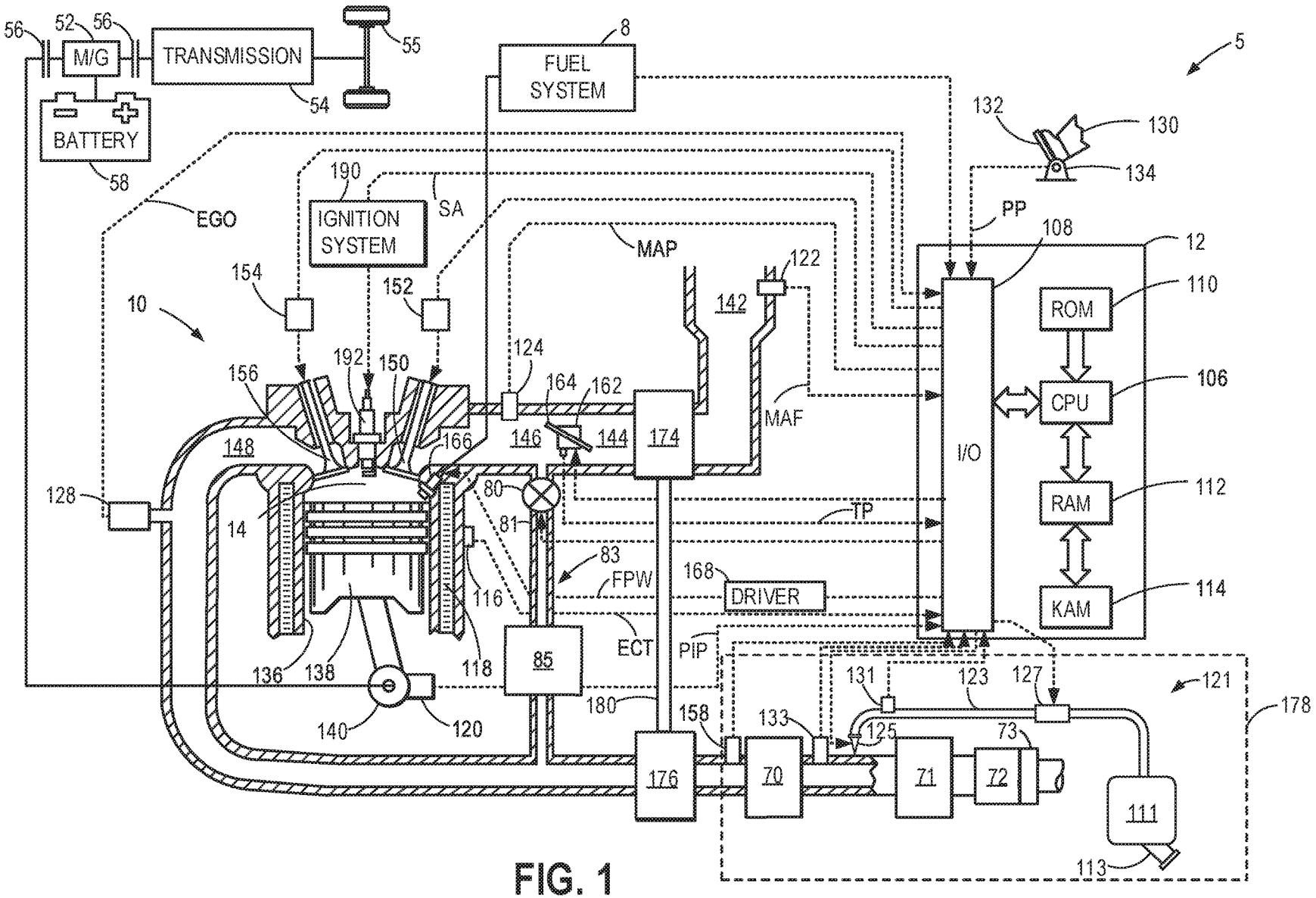
FIG. 1 shows a schematic depiction of an example vehicle system.

The following description relates to systems and methods for identifying degradation of a passive NOx adsorption catalyst (PNA) included in a vehicle system, such as the example vehicle shown in FIG. 1. In particular, a NOx storage capacity monitor (e.g., diagnostic routine) may be performed to determine if the PNA has a degraded NOx storage capacity or a non-degraded NOx storage capacity, such as according to the example method of FIG. 2. Specific entry conditions of the NOx storage capacity monitor result in the monitor being performed when a release of any stored NOx by the PNA is facilitated. As demonstrated in FIGS. 3A and 3B, vehicle drive time and exhaust gas temperature upstream of the PNA may be particularly relevant for clearly distinguishing between a degraded PNA and a non-degraded PNA. FIG. 4 shows an example timeline for performing the NOx storage capacity monitor in response to conditions for the NOx storage capacity monitor being met.

FIG. 1 shows an example embodiment of a cylinder 14 of an internal combustion engine 10, which may be included in a vehicle 5. Engine 10 may be controlled at least partially by a control system, including a controller 12, and by input from a vehicle operator 130 via an input device 132. In this example, input device 132 includes an accelerator pedal and a pedal position sensor 134 for generating a proportional pedal position signal PP. Cylinder (herein, also "combustion chamber") 14 of engine 10 may include combustion chamber walls 136 with a piston 138 positioned therein. Piston 138 may be coupled to a crankshaft 140 so that reciprocating motion of the piston is translated into rotational motion of the crankshaft. Crankshaft 140 may be coupled to at least one vehicle wheel 55 via a transmission 54, as further described below. Further, a starter motor (not shown) may be coupled to crankshaft 140 via a flywheel to enable a starting operation of engine 10.

In some examples, vehicle 5 may be a hybrid vehicle with multiple sources of torque available to one or more vehicle wheels 55. In other examples, vehicle 5 is a conventional vehicle with only an engine. In the example shown, vehicle 5 includes engine 10 and an electric machine 52. Electric machine 52 may be a motor or a motor/generator. Crankshaft 140 of engine 10 and electric machine 52 are connected via transmission 54 to vehicle wheels 55 when one or more clutches 56 are engaged. In the depicted example, a first clutch 56 is provided between crankshaft 140 and electric machine 52, and a second clutch 56 is provided between electric machine 52 and transmission 54. Controller 12 may send a signal to an actuator of each clutch 56 to engage or disengage the clutch, so as to connect or disconnect crankshaft 140 from electric machine 52 and the components connected thereto, and/or connect or disconnect electric machine 52 from transmission 54 and the components connected thereto. Transmission 54 may be a gearbox, a planetary gear system, or another type of transmission.

The powertrain may be configured in various manners including as a parallel, a series, or a series-parallel hybrid vehicle. In electric vehicle embodiments, a system battery 58 may be a traction battery that delivers electrical power to electric machine 52 to provide torque to vehicle wheels 55. In some embodiments, electric machine 52 may also be operated as a generator to provide electrical power to charge system battery 58, for example, during a braking operation. It will be appreciated that in other embodiments, including non-electric vehicle embodiments, system battery 58 may be a typical starting, lighting, ignition (SLI) battery coupled to an alternator.

Cylinder 14 of engine 10 can receive intake air via a series of intake air passages 142, 144, and 146. Intake air passage 146 can communicate with other cylinders of engine 10 in addition to cylinder 14. In some examples, one or more of the intake passages may include a boosting device, such as a turbocharger or a supercharger. For example, FIG. 1 shows engine 10 configured with a turbocharger, including a compressor 174 arranged between intake passages 142 and 144 and an exhaust turbine 176 arranged along an exhaust passage 148. Compressor 174 may be at least partially powered by exhaust turbine 176 via a shaft 180 when the boosting device is configured as a turbocharger. In some examples, exhaust turbine 176 may be a variable geometry turbine (VGT), where turbine geometry is actively varied by actuating turbine vanes as a function of engine speed and other operating conditions. In one example, the turbine vanes may be coupled to an annular ring, and the ring may be rotated to adjust a position of the turbine vanes. In another example, one or more of the turbine vanes may be pivoted individually or pivoted in plurality. As an example, adjusting the position of the turbine vanes may adjust a cross sectional opening (or area) of exhaust turbine 176. However, in other examples, such as when engine 10 is provided with a supercharger, compressor 174 may be powered by mechanical input from a motor or the engine and exhaust turbine 176 may be optionally omitted.

A throttle 162 including a throttle plate 164 may be provided in the engine intake passages for varying the flow rate and/or pressure of intake air provided to the engine cylinders. For example, throttle 162 may be positioned downstream of compressor 174, as shown in FIG. 1, or may be alternatively provided upstream of compressor 174. A throttle position sensor may be provided to measure a position of throttle plate 164. However, in some examples, such as when engine 10 is a diesel engine, throttle 162 may be omitted.

Exhaust passage 148 can receive exhaust gases from other cylinders of engine 10 in addition to cylinder 14. An exhaust gas sensor 128 is shown coupled to exhaust passage 148 upstream of turbine 176. Exhaust gas sensor 128 may be selected from among various suitable sensors for providing an indication of exhaust gas air/fuel ratio (AFR), such as a linear oxygen sensor or UEGO (universal or wide-range exhaust gas oxygen), a two-state oxygen sensor or EGO (as depicted), a HEGO (heated EGO), a NOx, a HC, or a CO sensor, for example.

Exhaust gas recirculation (EGR) may be provided to the engine via a high pressure EGR system 83, delivering exhaust gas from a zone of higher pressure in exhaust passage 148, upstream of turbine 176, to a zone of lower pressure in intake air passage 146, downstream of compressor 174 and throttle 162, via an EGR passage 81. In other examples (not shown in FIG. 1), low pressure EGR may additionally or alternatively be provided via a low pressure EGR system, coupling a region of exhaust passage 148 downstream of turbine 176 to intake air passage 142, upstream of compressor 174.

An amount EGR provided to intake passage 146 may be varied by controller 12 via an EGR valve 80. For example, controller 12 may adjust a position of EGR valve 80 to adjust the amount of exhaust gas flowing through EGR passage 81. EGR valve 80 may be adjusted between a fully closed position, in which exhaust gas flow through EGR passage 81 is blocked, and a fully open position, in which exhaust gas flow through the EGR passage is enabled. As an example, EGR valve 80 may be continuously variable between the fully closed position and the fully open position. As such, the controller may increase a degree of opening of EGR valve 80 to increase an amount of EGR provided to intake passage 146 and decrease the degree of opening of EGR valve 80 to decrease the amount of EGR provided to intake passage 146. EGR may be cooled via passing through EGR cooler 85 within EGR passage 81. EGR cooler 85 may reject heat from the EGR gases to engine coolant, for example.

Under some conditions, the EGR system may be used to regulate a temperature of an air and fuel mixture within cylinder 14. Thus, it may be desirable to measure or estimate the EGR mass flow. EGR sensors may be arranged within EGR passage 81 and may provide an indication of one or more of mass flow, pressure, and temperature of the exhaust gas, for example.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder. Intake valve 150 may be controlled by controller 12 via an actuator 152. Similarly, exhaust valve 156 may be controlled by controller 12 via an actuator 154. The positions of intake valve 150 and exhaust valve 156 may be determined by respective valve position sensors (not shown).

During some conditions, controller 12 may vary the signals provided to actuators 152 and 154 to control the opening and closing of the respective intake and exhaust valves. The valve actuators may be of an electric valve actuation type, a cam actuation type, or a combination thereof. The intake and exhaust valve timing may be controlled concurrently, or any of a possibility of variable intake cam timing, variable exhaust cam timing, dual independent variable cam timing, or fixed cam timing may be used. Each cam actuation system may include one or more cams and may utilize one or more of cam profile switching (CPS), variable cam timing (VCT), variable valve timing (VVT), and/or variable valve lift (VVL) systems that may be operated by controller 12 to vary valve operation. For example, cylinder 14 may alternatively include an intake valve controlled via electric valve actuation and an exhaust valve controlled via cam actuation, including CPS and/or VCT. In other examples, the intake and exhaust valves may be controlled by a common valve actuator (or actuation system) or a variable valve timing actuator (or actuation system).

Cylinder 14 can have a compression ratio, which is a ratio of volumes when piston 138 is at bottom dead center (BDC) to top dead center (TDC). In one example, the compression ratio is in the range of 9:1 to 10:1. However, in some examples, such as where different fuels are used, the compression ratio may be increased. This may happen, for example, when higher octane fuels or fuels with higher latent enthalpy of vaporization are used. The compression ratio may also be increased if direct injection is used due to its effect on engine knock.

In some examples, each cylinder of engine 10 may include a spark plug 192 for initiating combustion. An ignition system 190 can provide an ignition spark to combustion chamber 14 via spark plug 192 in response to a spark advance signal SA from controller 12, under select operating modes. A timing of signal SA may be adjusted based on engine operating conditions and driver torque demand. For example, spark may be provided at maximum brake torque (MBT) timing to maximize engine power and efficiency. Controller 12 may input engine operating conditions, including engine speed, engine load, and exhaust gas AFR, into a look-up table and output the corresponding MBT timing for the input engine operating conditions. However, in other examples, such as when engine 10 is a diesel engine, spark plug 192 may be omitted, and ignition may be initiated via fuel injection into hot, compressed air.

For example, each cylinder of engine 10 may be configured with one or more fuel injectors for providing fuel thereto. As a non-limiting example, cylinder 14 is shown including a fuel injector 166. Fuel injector 166 may be configured to deliver fuel received from a fuel system 8. Fuel system 8 may include one or more fuel tanks, fuel pumps, and fuel rails. Fuel injector 166 is shown coupled directly to cylinder 14 for injecting fuel directly therein in proportion to the pulse width of a signal FPW received from controller 12 via an electronic driver 168. In this manner, fuel injector 166 provides what is known as direct injection (hereafter also referred to as "DI") of fuel into cylinder 14. While FIG. 1 shows fuel injector 166 positioned to one side of cylinder 14, fuel injector 166 may alternatively be located overhead of the piston, such as near the position of spark plug 192. Alternatively, the injector may be located overhead and near the intake valve to increase mixing. Fuel may be delivered to fuel injector 166 from a fuel tank of fuel system 8 via a high pressure fuel pump and a fuel rail. Further, the fuel tank may have a pressure transducer providing a signal to controller 12.

Fuel injector 166 may be configured to receive different fuels from fuel system 8 in varying relative amounts as a fuel mixture and further configured to inject this fuel mixture directly into cylinder 14. Further, fuel may be delivered to cylinder 14 during different strokes of a single cycle of the cylinder. For example, directly injected fuel may be delivered at least partially during a previous exhaust stroke, during an intake stroke, and/or during a compression stroke. As such, for a single combustion event, one or multiple injections of fuel may be performed per cycle. The multiple injections may be performed during the compression stroke, intake stroke, or any appropriate combination thereof in what is referred to as split fuel injection.

Fuel tanks in fuel system 8 may hold fuels of different fuel types, such as fuels with different fuel qualities and different fuel compositions. The differences may include different alcohol contents, different water contents, different octane numbers, different heats of vaporization, different fuel blends, and/or combinations thereof, etc. As an example, fuel tanks in fuel system 8 may hold diesel fuel or one or more diesel fuel blends. As another example, fuel tanks in fuel system 8 may hold gasoline or one or more gasoline blends. Moreover, fuel characteristics of one or both more tanks may vary frequently, for example, due to day to day variations in tank refilling.

An exhaust after-treatment system 178 is shown arranged along exhaust passage 148 downstream of exhaust gas sensor 128. Exhaust after-treatment system 178 may include a selective catalytic reduction (SCR) system, a three way catalyst (TWC), a NOx trap, various other emission control devices, or combinations thereof. In the example of FIG. 1, exhaust after-treatment system 178 includes a passive NOx adsorption catalyst (PNA, also referred to herein as a "cold start catalyst") 70 positioned upstream of a SCR catalyst 71. PNA 70 may passively absorb (e.g., store) and desorb (e.g., release) NOx in a temperature dependent manner. For example, PNA 70 may store NOx at lower temperatures and release the stored NOx at higher temperatures. The NOx released by PNA 70 may be treated downstream at SCR catalyst 71, as further described below. Exhaust after-treatment system 178 may further include a diesel oxidation catalyst (DOC) 72 and a diesel particulate filter (DPF) 73 coupled downstream of SCR catalyst 71. In some examples, DPF 73 may be located downstream of the DOC (as shown in FIG. 1), while in other examples, DPF 73 may be positioned upstream of the DOC or the SCR. DOC 72 and/or DPF 73 may be thermally regenerated periodically during engine operation. Furthermore, fuel may be injected upstream of DOC 72 to aid in the regeneration of DOC 72.

Engine exhaust systems may use various injections of a reductant to assist in the reaction of various exhaust gas components. For example, a reductant injection system may be provided to inject a suitable reductant, such as diesel exhaust fluid (DEF), to SCR catalyst 71. However, various alternative approaches may be used, such as solid urea pellets that generate an ammonia vapor, which is then injected or metered to SCR catalyst 71. As shown in FIG. 1, exhaust after-treatment system 178 includes a DEF dosing system 121. The DEF may be a liquid reductant, such as an aqueous urea solution. In one example, the DEF dosing system 121 may include DEF tank 111 for onboard DEF storage and a DEF delivery line 123 that couples the DEF tank to exhaust passage 148 via a DEF injector 125 at or upstream of SCR catalyst 71. The DEF tank 111 may be of various forms and may include a fill neck 113 and a corresponding cap and/or cover door in the vehicle body. Fill neck 113 may be configured to receive a nozzle for replenishing DEF.

DEF injector 125 in DEF delivery line 123 injects DEF into the exhaust upstream of SCR catalyst 71. Controller 12 may use DEF injector 125 to control the timing and amount of DEF injections. DEF dosing system 121 may further include a DEF pump 127. DEF pump 127 may be used to pressurize and deliver DEF into the DEF delivery line 123. A pressure sensor 131 coupled to DEF delivery line 123 upstream of DEF pump 127 and downstream of DEF injector 125 may be included in DEF dosing system 121 to provide an indication of DEF delivery pressure.

Further, one or more sensors, e.g., pressure, temperature, and/or NOx sensors, may be included in the exhaust passage and/or in exhaust after-treatment system 178 to monitor parameters associated with devices included in the exhaust after-treatment system. As shown in FIG. 1, exhaust after-treatment system 178 includes an exhaust gas temperature sensor 158 coupled to exhaust passage 148 upstream of and adjacent to PNA 70 and a NOx sensor 133 coupled to exhaust passage 148 downstream of PNA 70 and upstream of DEF injector 125. For example, NOx sensor 133 may be a NOx feedgas sensor configured to measure an amount of NOx output from PNA 70 and input into SCR catalyst 71. As one example, the amount of NOx measured by NOx sensor 133 may be used by controller 12 to determine DEF injection parameters. As another example, as will be described below with respect to FIG. 2, the amount of NOx measured by NOx sensor 133 may be used under select conditions to determine when a NOx storage capacity of the PNA 70 is degraded.

Controller 12 is shown in FIG. 1 as a microcomputer, including a microprocessor unit 106, input/output ports 108, an electronic storage medium for executable programs (e.g., executable instructions) and calibration values shown as non-transitory read-only memory chip 110 in this particular example, random access memory 112, keep alive memory 114, and a data bus. Controller 12 may receive various signals from sensors coupled to engine 10, including the signals previously discussed and additionally including a measurement of inducted mass air flow (MAF) from a mass air flow sensor 122; an engine coolant temperature (ECT) from a temperature sensor 116 coupled to a cooling sleeve 118; a profile ignition pickup signal (PIP) from a Hall effect sensor 120 (or other type) coupled to crankshaft 140; throttle position (TP) from the throttle position sensor; signal EGO from exhaust gas sensor 128, which may be used by controller 12 to determine the AFR of the exhaust gas; an exhaust gas temperature at PNA 70 from exhaust gas temperature sensor 158; the amount (or concentration) of NOx between PNA 70 and SCR catalyst 71 from NOx sensor 133; the DEF delivery pressure from pressure sensor 131; and an absolute manifold pressure signal (MAP) from a MAP sensor 124. An engine speed signal, RPM, may be generated by controller 12 from signal PIP. The manifold pressure signal MAP from MAP sensor 124 may be used to provide an indication of vacuum or pressure in the intake manifold. Controller 12 may infer an engine temperature based on the engine coolant temperature.

Controller 12 receives signals from the various sensors of FIG. 1 and employs the various actuators of FIG. 1 to adjust engine operation based on the received signals and instructions stored on a memory of the controller. For example, upon receiving signals from various sensors, including NOx sensor 133, the engine controller may monitor the NOx storage capacity of PNA 70 and, in response to an indication of degradation, adjust engine actuators to reduce NOx formation (e.g., increase an opening of EGR valve 80, retard a timing of fuel injection by fuel injector 166, etc.), as further described below with respect to FIG. 2.

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

A passive NOx absorption catalyst, such as PNA 70 of FIG. 1, may function as a cold start catalyst, storing NOx produced by a vehicle engine (e.g., engine 10 of FIG. 1) during a cold start and during vehicle operation with cold exhaust. During such conditions, a downstream selective catalytic reduction catalyst (e.g., SCR catalyst 71 of FIG. 1) may not have reached its light-off temperature for reducing NOx. Therefore, the PNA may store the NOx during colder conditions, when the SCR catalyst is not active, and release the stored NOx during hotter conditions, when the SCR catalyst is active and able to reduce the NOx. When the NOx storage capacity of the PNA becomes degraded, vehicle NOx emissions may increase, particularly during the cold start period.

Figure 2:
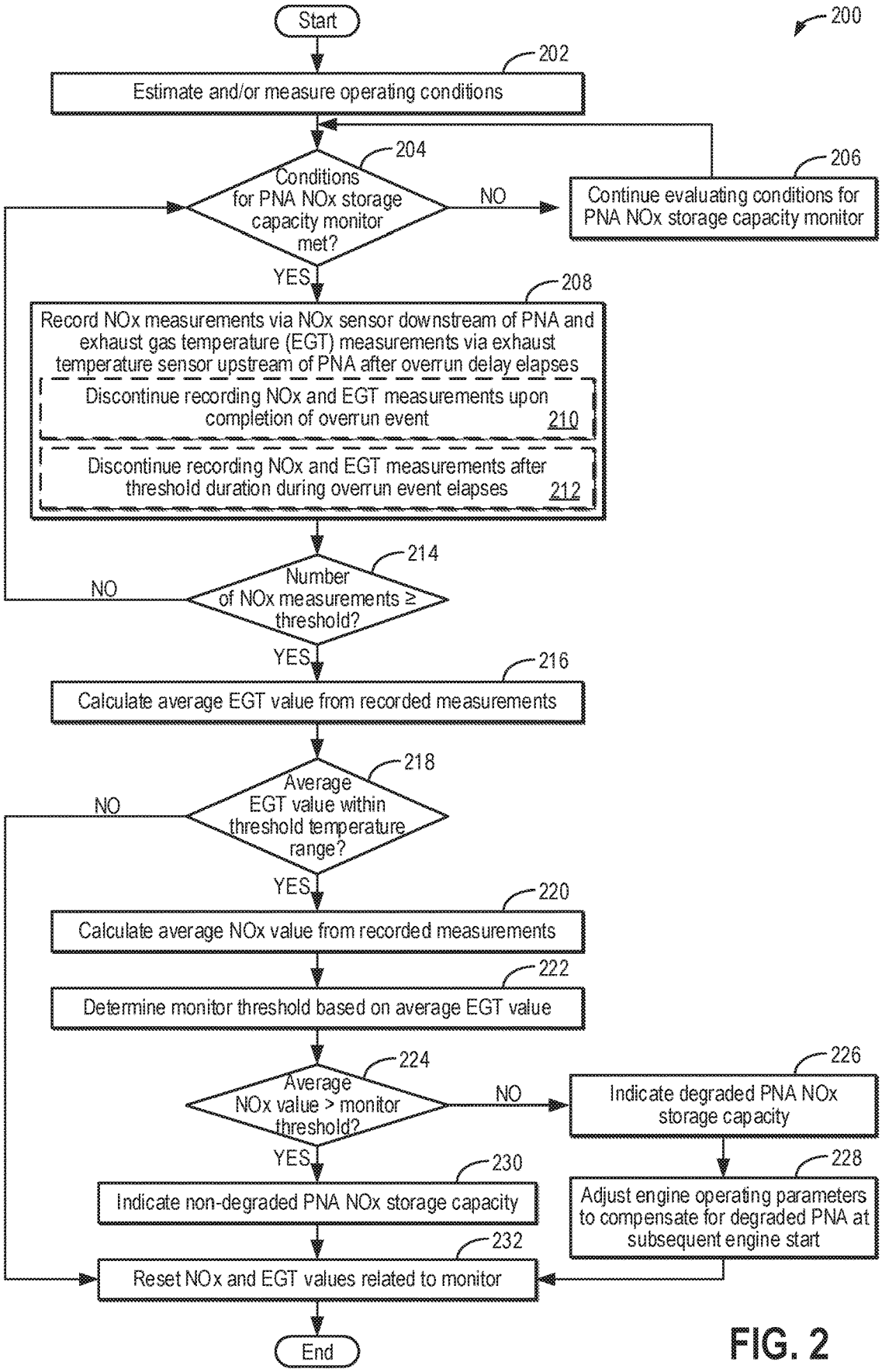
FIG. 2 is a flow chart of an example method for performing a NOx storage capacity monitor to determine degradation of a passive NOx adsorption catalyst.

Therefore, FIG. 2 shows an example method 200 for monitoring the NOx storage capacity of a PNA positioned upstream of a SCR catalyst (such as PNA 70 and SCR catalyst 71 shown in FIG. 1). In particular, method 200 enables the NOx storage capacity of the PNA to be monitored with a single, downstream NOx sensor under conditions that facilitate NOx release from the PNA after sufficient NOx has been stored. Furthermore, method 200 may identify PNA degradation, prompting the PNA to be repaired or replaced in a timely fashion. Instructions for carrying out method 200 and the rest of the methods included herein may be executed by a controller (e.g., controller 12 of FIG. 1) based on instructions stored on a memory of the controller and in conjunction with signals received from sensors of the engine system, such as the sensors described above with reference to FIG. 1 (e.g., NOx sensor 133). The controller may employ engine actuators of the engine system (e.g., EGR valve 80 and fuel injector 166 of FIG. 1) to adjust engine operation according to the methods described below.

Method 200 begins at 202 and includes estimating and/or measuring operating conditions. The operating conditions may be measured by one or more sensors communicatively coupled to the controller or may be inferred based on available data. The operating conditions may include, for example, ambient temperature, ambient pressure, vehicle speed, engine speed, engine load, mass air flow, an engine dilution (e.g., an amount of EGR provided to the engine), an engine temperature, an exhaust gas temperature upstream of the PNA (e.g., as measured by exhaust gas temperature sensor 158 of FIG. 1), fuel injection parameters (e.g., a fuel injection amount and timing), a vehicle drive time with the engine on and operating (e.g., with combustion occurring in engine cylinders) during the current vehicle drive cycle (e.g., since a key-on event, when the ignition switch of the vehicle is placed in an "on" position from an "off" position and power is provided to vehicle systems), a state of the NOx sensor (e.g., whether the NOx sensor has reached light-off), an engine soak duration prior to the current drive cycle, etc.

The operating conditions may further include a modeled stored NOx value. For example, the controller may use a NOx storage model to estimate an amount of NOx currently stored at the PNA by increasing (or incrementing) the modeled stored NOx value during conditions that facilitate NOx storage by the PNA (e.g., during engine operation while the exhaust gas temperature upstream of the PNA is colder) and decreasing (or decrementing) the modeled stored NOx value during conditions that facilitate NOx release by the PNA (e.g., during engine operation while the exhaust gas temperature upstream of the PNA is hotter). As an example, the modeled stored NOx value may increase when the exhaust gas temperature upstream of the PNA is less than a threshold temperature, and the modeled stored NOx value may decrease when the exhaust gas temperature upstream of the PNA is greater than the threshold temperature. The threshold temperature value may correspond to a temperature at which the PNA transitions between primarily storing NOx (e.g., greater than half of the NOx input into the PNA is stored) and primarily releasing NOx (e.g., less than half of the NOx input into the PNA is stored, and additional stored NOx is released). As one non-limiting example, the threshold temperature may be around 230° C.

A degree to which the modeled stored NOx value is increased or decreased may be further modeled based on one or more of a difference between the exhaust gas temperature upstream of the PNA and the threshold temperature, an amount of time the engine has been operated above or below the threshold temperature, and engine operating parameters that affect an amount of NOx produced by the engine (e.g., engine speed, fuel injection parameters, engine dilution, etc.). For example, as the difference between the exhaust gas temperature upstream of the PNA and the threshold temperature becomes greater in the negative direction (e.g., the exhaust gas temperature upstream of the PNA is less than the threshold temperature to a larger degree), the modeled stored NOx value may be increased to a greater degree. Similarly, as the engine operating time with the exhaust gas temperature upstream of the PNA less than the threshold temperature increases, the modeled stored NOx value may be increased to a greater degree. As another example, as the difference between the exhaust gas temperature upstream of the PNA and the threshold temperature becomes greater in the positive direction (e.g., the exhaust gas temperature upstream of the PNA is greater than the threshold temperature to a larger degree) and/or the engine operating time with the exhaust gas temperature upstream of the PNA greater than the threshold temperature increases, the modeled stored NOx value may be decreased to a greater degree. As a further example, as the amount of NOx produced by the engine increases during NOx storage conditions (e.g., while the exhaust gas temperature upstream of the PNA is less than the threshold temperature), the modeled stored NOx value may be increased to a greater degree. Thus, the model may take into account how NOx production by the engine, the temperature upstream of the PNA, and the engine operating time at various exhaust gas temperatures affect NOx storage by the PNA. Further, the controller may store the modeled NOx storage value in non-volatile memory (e.g., non-volatile RAM) so that the value is retained and updated across multiple drive cycles.

At 204, method 200 includes determining if conditions for the PNA NOx storage capacity monitor are met. Conditions for the PNA NOx storage capacity monitor may include the NOx sensor having reached light-off, after which an output of the NOx sensor accurately reflects a concentration of NOx in the exhaust gas, the exhaust gas temperature upstream of the PNA being within a threshold temperature range, the modeled stored NOx value being greater than a lower threshold stored NOx value, and an overrun event being present. For example, the threshold temperature range may be defined by a lower threshold temperature, below which the PNA may store NOx instead of releasing NOx, and an upper threshold temperature, above which the stored NOx may have already been released. Therefore, the threshold temperature range encompasses temperatures over which NOx release is expected to occur. As one non-limiting example, the threshold range is between approximately 200° C. (e.g., the lower threshold temperature) and approximately 260° C. (e.g., the upper threshold temperature). The upper threshold temperature and the lower threshold temperature may be pre-calibrated, for example, by measuring NOx storage and release by the PNA over a range of temperatures. Further, the lower threshold temperature may be greater than the threshold temperature defined above at 202. For example, the lower threshold temperature may be slightly greater than a temperature at which the PNA begins to release NOx. Furthermore, at stored NOx values below the lower threshold stored NOx value, an insufficient amount of NOx may be stored for detecting NOx release by a non-degraded PNA during an overrun event. The lower threshold stored NOx value may be pre-calibrated for a particular PNA during manufacture, for example.

The overrun event is a fuel-cut event during which the engine remains operating at a non-zero speed, but fuel injection is temporarily discontinued. As such, combustion does not occur in the engine during the overrun event. For example, the overrun event may be a deceleration fuel shut-off (DFSO) event. By including the overrun event as an entry condition, any NOx measured downstream of the PNA is due to NOx release by the PNA and not from a current stream of combusted exhaust gas through the PNA. In some examples, the conditions for the PNA NOx storage capacity monitor may further include a number of overrun events being less than a threshold since the exhaust gas temperature upstream of the PNA surpassed the lower threshold temperature. In this way, NOx depletion due to multiple overrun events in short succession may be reduced. In some examples, the conditions for the PNA NOx storage capacity monitor may further include operating with the exhaust gas temperature within the threshold temperature range for less than a first threshold duration. The first threshold duration may be a first pre-determined time duration above which any stored NOx is expected to have been released. As one non-limiting example, the first threshold duration is approximately 2 minutes. In another example, the first threshold duration may be adjusted based on an average exhaust gas temperature upstream of the PNA during the current vehicle drive cycle. For example, the first threshold duration may increase as the average exhaust gas temperature decreases, and the first threshold duration may decrease as the average exhaust gas temperature increases. As still another example, the first threshold duration may be adjusted based on the modeled stored NOx value. However, as described above, the NOx storage model takes into account the exhaust gas temperature upstream of the PNA and other engine operating parameters (including operating time), so in other examples, operating with the exhaust gas temperature within the threshold range for less than the first threshold duration may be omitted as an entry condition for the PNA NOx storage capacity monitor. The effect of the vehicle drive time and the upstream exhaust gas temperature on the PNA NOx storage capacity monitor will be further described below with respect to FIGS. 3A and 3B.

The conditions for the PNA NOx storage capacity monitor may further include the ambient temperature and the ambient pressure being within predetermined thresholds, enabling standardization of the monitor to meet regulatory requirements, and no other diagnostic trouble codes (DTCs) present (e.g., set at the controller) for the NOx sensor and the exhaust gas temperature sensor. In some examples, the conditions may further include the NOx sensor output having surpassed a threshold output. The threshold output may be a non-zero output value corresponding to a non-zero concentration of NOx downstream of the PNA. For example, in the case of a non-degraded PNA, the NOx sensor output being greater than the threshold output may indicate that NOx is being released from the PNA.

If the conditions for the PNA NOx storage capacity monitor are not met, method 200 proceeds to 206 and includes continuing to evaluate the conditions for the PNA NOx storage capacity monitor. The method at 206 may further include continuing current engine operation. Method 200 may then return to 204 so that the PNA NOx storage capacity monitor may be performed once conditions are met.

If each and every one of the conditions for the PNA NOx storage capacity monitor are met, method 200 proceeds to 208 and includes recording NOx measurements via the NOx sensor positioned downstream of the PNA (and upstream of the SCR catalyst) and recording exhaust gas temperature (EGT) measurements via the exhaust gas temperature sensor coupled upstream of the PNA after an overrun delay elapses. The overrun delay may correspond to a second threshold duration that is less than the first threshold duration (e.g., described above at 204) that enables existing exhaust gas to be flushed away and replaced by fresh air pumped through the engine in the overrun event. Therefore, any measured NOx corresponds to NOx released by the PNA and not NOx from the engine exhaust. As an example, at a beginning of the overrun event, the controller may determine the second threshold duration. The second threshold duration may be a second pre-determined time duration, such as 5 seconds, as one non-limiting example. As another example, the second threshold duration may be determined based on engine operating conditions, such as the engine speed and/or mass air flow. For example, the controller may input the engine speed and/or mass air flow into a look-up table, algorithm, or function and output the second threshold duration. As the engine speed and/or mass air flow increases, the second threshold duration may decrease, for example.

In response to the overrun delay elapsing, the controller may obtain and record (e.g., store) NOx values from an output of the NOx sensor coupled downstream of the PNA and obtain and record EGT values from an output the exhaust gas temperature sensor coupled upstream of the PNA at a predetermined sampling frequency. The NOx and EGT values may be stored in keep alive memory (e.g., keep alive memory 114 of FIG. 1), for example, so that the controller may retain the values over multiple vehicle key cycles. Further, it should be understood that if the PNA NOx storage capacity monitor conditions are no longer met at any time during method 200, the method may abort or may return to 204. As one example, if fuel injection resumes, signaling an end of the overrun event, before the overrun delay elapses, the monitor conditions are no longer met, and the NOx and EGT measurements will not be recorded. As another example, if the modeled stored NOx value is no longer greater than the lower threshold stored NOx value, the monitor conditions are no longer met, and the NOx and EGR measurements will not be recorded.

The controller may continue obtaining and recording the NOx and EGT measurements until the overrun event is complete, as indicated at 210, or until a third threshold duration during the overrun event elapses, as indicated at 212. For example, at the end of a very long overrun event, an amount of NOx released by the PNA (and measured by the downstream NOx sensor) may sharply decrease. By limiting data capture to the third threshold duration, NOx values that may reduce an accuracy of the NOx storage capacity monitor may be avoided. The third threshold duration may be a third pre-determined time duration, which may be the same as or different from the second pre-determined time duration. The third threshold duration may be an amount of time over which NOx values from NOx release by a non-degraded PNA are expected to remain approximately stable (e.g., within 5-10% of a first recorded value). As one non-limiting example, the third threshold duration may be 4 seconds. As another example, the third threshold duration may correspond to a threshold number of sample counts for a given sampling frequency. Therefore, the controller may discontinue recording the NOx and EGT values upon completion of the overrun event if the overrun event lasts for less than the third threshold duration (e.g., as indicated at 210), or, if the overrun event continues past the third threshold duration, the controller may discontinue recording the NOx and EGR values at the third threshold duration (e.g., as indicated at 212). As an example, upon completion of the overrun delay, the controller may determine the third threshold duration and begin recording the NOx and EGT measurements.

At 214, method 200 includes determining if a number of recorded NOx measurements is greater than or equal to a threshold number. The threshold number may be a pre-calibrated value for increasing a probability that an average NOx value calculated from the recorded NOx measurements is representative of the measured values. For example, if the number of recorded NOx measurements is smaller than the threshold number, any outlier measurements may have a higher weight in the average calculation than when the number of recorded NOx measurements is greater than or equal to the threshold number. As such, at least in some examples, the threshold number of recorded NOx measurements may not be obtained during a single overrun event (e.g., may be obtained during multiple overrun events within a drive cycle or within different drive cycles).

If the number of recorded NOx measurements is not greater than or equal to the threshold number (e.g., the number of recorded NOx measurements is less than the threshold number), method 200 returns to 204 and includes determining if conditions for the PNA NOx storage capacity monitor are met. In this way, the controller may continue storing NOx measurements and EGT measurements across multiple overrun events during a single vehicle key cycle, multiple overrun events during different vehicle key cycles, or a combination thereof until the number of NOx measurements is greater than or equal to the threshold and there are enough recorded NOx measurements to proceed in the PNA NOx storage capacity monitor.

If the number of recorded NOx measurements is greater than or equal to the threshold, method 200 proceeds to 216 and includes calculating an average EGT value from the recorded EGT measurements. As mentioned above, the EGT measurements may be recorded during one or during a plurality of overrun events. For example, the controller may determine the arithmetic mean of the recorded EGT measurements by dividing a sum of the recorded EGT measurements by a number of the recorded EGT measurements.

At 218, method 200 includes determining if the average EGT value is within the threshold temperature range. Although the current EGT value was compared to the threshold temperature range as an entry condition for the PNA NOx storage capacity monitor at 204, comparing the average EGT value (e.g., as calculated at 216) to the threshold temperature range ensures that any temperature fluctuations during the recording of the NOx sensor measurements do not confound the PNA NOx storage capacity monitor.

If the average EGT value is not within the threshold temperature range, method 200 proceeds to 232 and includes resetting the NOx and EGT values related to the monitor. The measured NOx and EGT values may not give an accurate determination of the NOx storage capacity status of the PNA, and so the measured NOx and EGT values may be disqualified for completing the monitor. For example, method 200 at 232 may include deleting the NOx and EGT values from the keep alive memory. Method 200 may then end. As one example, method 200 may repeat so that new NOx and EGT measurements may be recorded responsive to entry conditions for the PNA NOx storage capacity monitor being met.

If the average EGT value is within the threshold temperature range, method 200 proceeds to 220 and includes calculating the average NOx value from the recorded NOx measurements. As mentioned above, the NOx measurements may be recorded during one or during a plurality of overrun events. The controller may determine the arithmetic mean of the recorded NOx measurements by dividing a sum of the recorded NOx measurements by the number of the recorded NOx measurements, for example.

At 222, method 200 includes determining a monitor threshold based on the average EGT value (e.g., as determined at 216). The monitor threshold is an amount (e.g., concentration) of NOx that is used for differentiating between a healthy PNA with a non-degraded storage capacity and an unhealthy PNA with a degraded NOx storage capacity, as further described below. Because NOx absorption and desorption by the PNA is dependent on temperature, the controller may input the average EGT value into a look-up table or function and output the corresponding monitor threshold. As an example, as the average EGT value increases, the monitor threshold may decrease, and as the average EGT value decreases, the monitor threshold may increase.

At 224, method 200 includes determining if the average NOx value is greater than the monitor threshold. Because the PNA NOx storage capacity monitor is performed under conditions that facilitate the release of stored NOx from the PNA, average NOx values that are less than the monitor threshold denote a lack of NOx release, which may be inferred to be from a lack of stored NOx (e.g., due to degradation of the NOx storage capacity of the PNA). Therefore, if the average NOx value is not greater than the monitor threshold (e.g., the average NOx value is less than or equal to the monitor threshold), method 200 proceeds to 226 and includes indicating a degraded PNA NOx storage capacity. That is, the PNA has failed the PNA NOx storage capacity monitor and has been determined to be degraded. Indicating the degraded PNA NOx storage capacity may include setting a corresponding DTC at the controller and alerting a vehicle operator of the degradation, such as by illuminating a malfunction indicator lamp (MIL) on an instrument panel of the vehicle.

At 228, method 200 includes adjusting engine operating parameters to compensate for the degraded PNA at a subsequent engine start. The adjustments may include adjustments to reduce NOx formation, such as one or more of increasing an amount of EGR, retarding a fuel injection timing, and performing a split fuel injection during a subsequent engine start. Because the PNA is not able to store NOx during the engine start, by reducing NOx formation prior to the SCR catalyst reaching light-off and being able to reduce the NOx, NOx emissions may be decreased prior to the PNA being repaired or replaced. For example, the controller may make a logical determination (e.g., regarding the amount of EGR, fuel injection timing, and/or fuel injection number) based on logic rules that are a function of a desired combustion temperature for reduced NOx formation. The controller may then generate a first control signal that is sent to an EGR valve (e.g., EGR valve 80 of FIG. 1) to adjust the EGR valve to a position for providing the desired amount of EGR and a second control signal that is sent to the fuel injector at the desired fuel injection timing, for example. However, the strategies that decrease NOx formation also decrease combustion temperature, which may delay the downstream SCR catalyst reaching light-off. Therefore, in an alternative example, the adjustments may include adjustments to expedite the SCR catalyst reaching light-off, such as by decreasing the amount of EGR, advancing the fuel injection timing, and performing a single fuel injection. In still another alternative example, the controller may make a determination of whether to decrease the combustion temperature (and thereby decrease NOx formation and delay light-off of the SCR catalyst) or increase the combustion temperature (and thereby increase NOx formation and expedite light-off the SCR catalyst) based on the engine temperature at the engine start. For example, the controller may input the engine temperature at the engine start into one or more look-up tables, algorithms, or functions and output the EGR amount and fuel injection strategy that is expected to result in the smallest amount of NOx emissions.

Returning to 224, if the average NOx value is greater than the monitor threshold, method 200 proceeds to 230 and includes indicating a non-degraded PNA NOx storage capacity. Because the NOx is measured during the overrun event, when fresh air is pumped through the engine, any NOx measured downstream of the PNA is from NOx that had been stored by the PNA that is currently being released. Therefore, with the average NOx value greater than the monitor threshold, the PNA has passed the PNA NOx storage capacity monitor and has been determined to be non-degraded.

From both 228 and 230, method 200 proceeds to 232 and includes resetting the NOx and EGT values related to the monitor, as described above. Therefore, whether the PNA passes the monitor, fails the monitor, or is disqualified from the monitor (e.g., due to the average EGT value being outside of the threshold range), the stored NOx and EGT values are deleted from the keep alive memory so that new values may be subsequently recorded. Following 232, method 200 ends.

In this way, the NOx storage capacity of the PNA may be reliably diagnosed based on an amount of NOx released from the PNA and independent of an amount of NOx input into the PNA. By including a single NOx sensor downstream of the PNA and omitting a NOx sensor upstream of the PNA, vehicle costs may be reduced. Further, potential points of degradation of the vehicle are reduced by omitting the upstream NOx sensor. By reliably identifying degradation of the NOx storage capacity of the PNA, vehicle NOx emissions may be reduced, particularly during engine cold starts.

Thus, as illustrated by examples herein, a method of operating an engine and performing actions responsive to a determination of an overrun event may include operating in the overrun event (e.g., operating with the vehicle traveling at a non-zero speed and the engine spinning at a non-zero speed), determining whether the overrun event is present (such as based on sensor output, e.g., based on output from an accelerator pedal position sensor) and performing actions in response thereto, as well as operating without the overrun event present, determining that the overrun event is not present, and performing a different action in response thereto. For example, in response to the overrun event, a controller may cease fuel injection to the engine and assess additional conditions for performing a PNA NOx storage capacity monitor, and in response to the overrun event not being present, the controller may continue to provide fuel injection to the engine and not perform the PNA NOx storage capacity monitor. As an example, the additional conditions for performing the PNA NOx storage capacity monitor may include a modeled stored NOx value being greater than a lower threshold value and an exhaust gas temperature measured upstream of the PNA being within a threshold temperature range.

As an example, the method may include determining whether the additional conditions for performing the PNA NOx storage capacity monitor are met while operating in the overrun event (such as based on sensor output, e.g., based on output from an exhaust gas temperature sensor) and performing actions in response thereto, as well as operating without the additional conditions for performing the PNA NOx storage capacity monitor met while operating in the overrun event, determining that the additional conditions for performing the PNA NOx storage capacity monitor are not met, and performing a different action in response thereto. For example, in response to the additional conditions for performing the PNA NOx storage capacity monitor being met, the controller may record NOx measurements downstream of the PNA (e.g., from output of a NOx sensor positioned downstream of the PNA and upstream of a SCR catalyst) and exhaust gas temperature measurements upstream of the PNA, determine a NOx threshold based on the recorded exhaust gas temperature measurements, and indicate whether the PNA is degraded or non-degraded based on the recorded NOx measurements relative to the NOx threshold; and in response to the additional conditions for the PNA NOx storage capacity monitor not being met, the controller may not record the NOx measurements and the exhaust gas temperature measurements. The method may further include adjusting engine operating parameters based on whether the PNA is degraded or non-degraded. As an example, in response to indicating the PNA is degraded, the method may include operating with the degraded PNA and adjusting engine operating parameters, such as one or more of an engine dilution, a fuel injection timing, and a fuel injection number upon a subsequent engine start, and in response to indicating the PNA is non-degraded, operating with the non-degraded PNA and not adjusting the engine dilution, the fuel injection timing, and the fuel injection number upon the subsequent engine start.

Figure 3A:
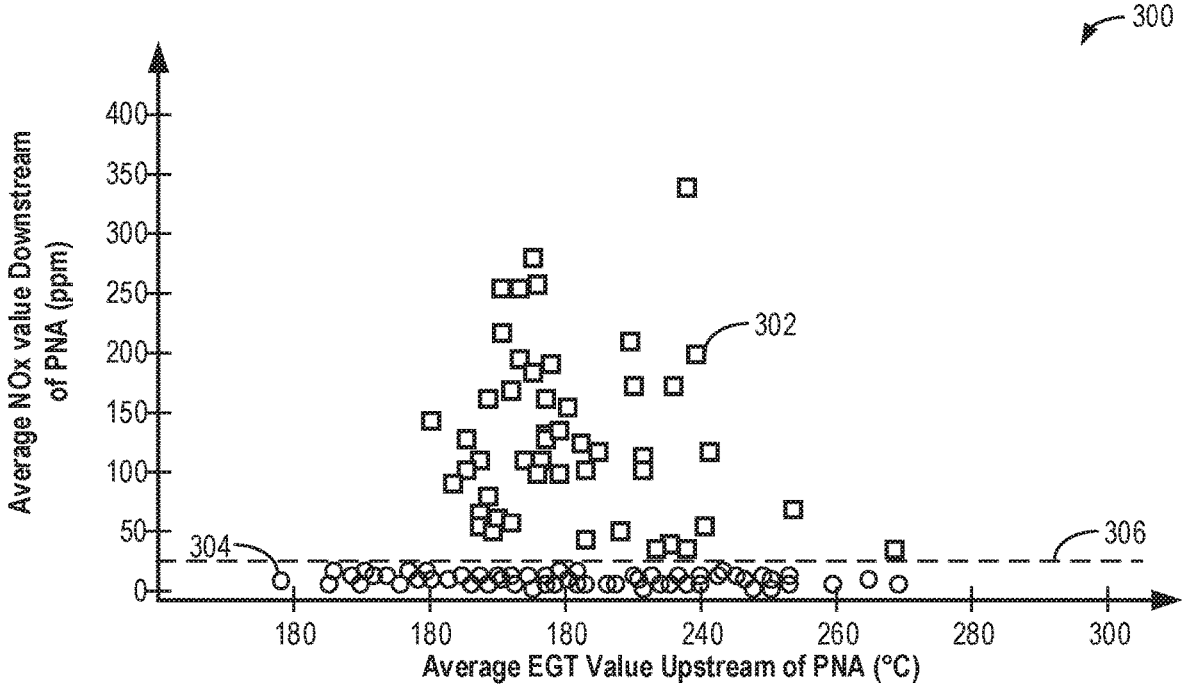
FIG. 3A shows an example scatterplot demonstrating how a non-degraded passive NOx adsorption catalyst can be distinguished from a degraded passive NOx adsorption catalyst when particular entry conditions for performing the NOx storage capacity monitor are met.
Figure 3B:
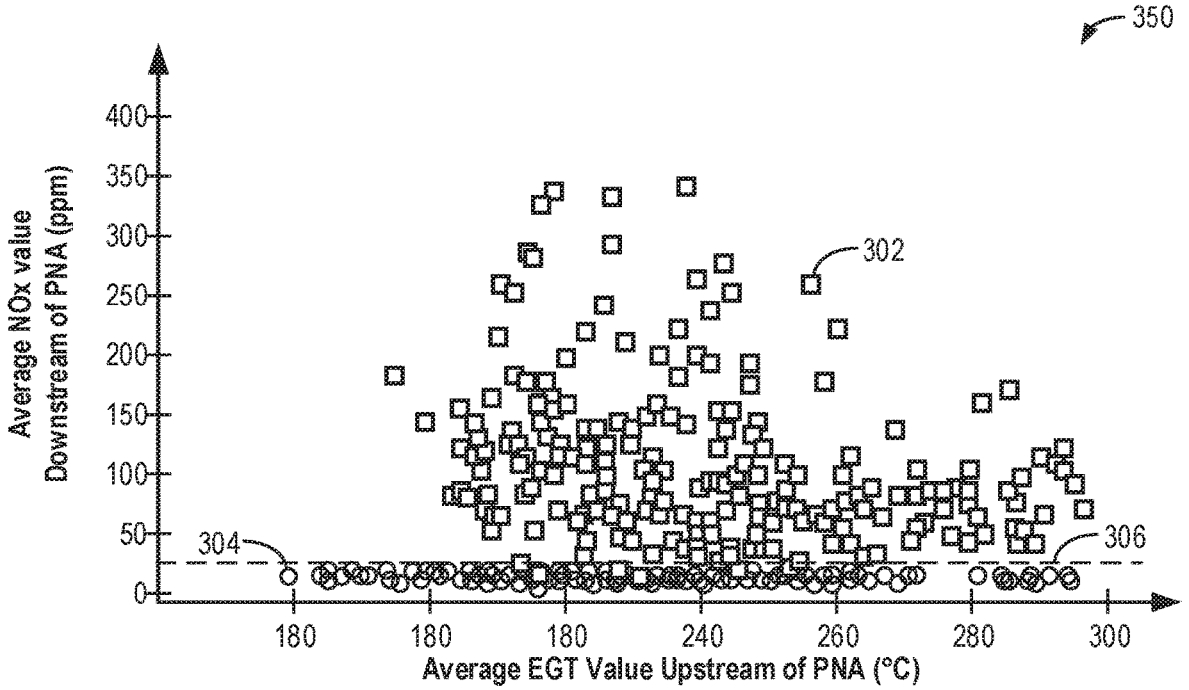
FIG. 3B shows an example scatterplot demonstrating how a non-degraded passive NOx adsorption catalyst cannot be reliably distinguished from a degraded passive NOx adsorption catalyst when particular entry conditions for performing the NOx storage capacity monitor are not met.
Figure 4:
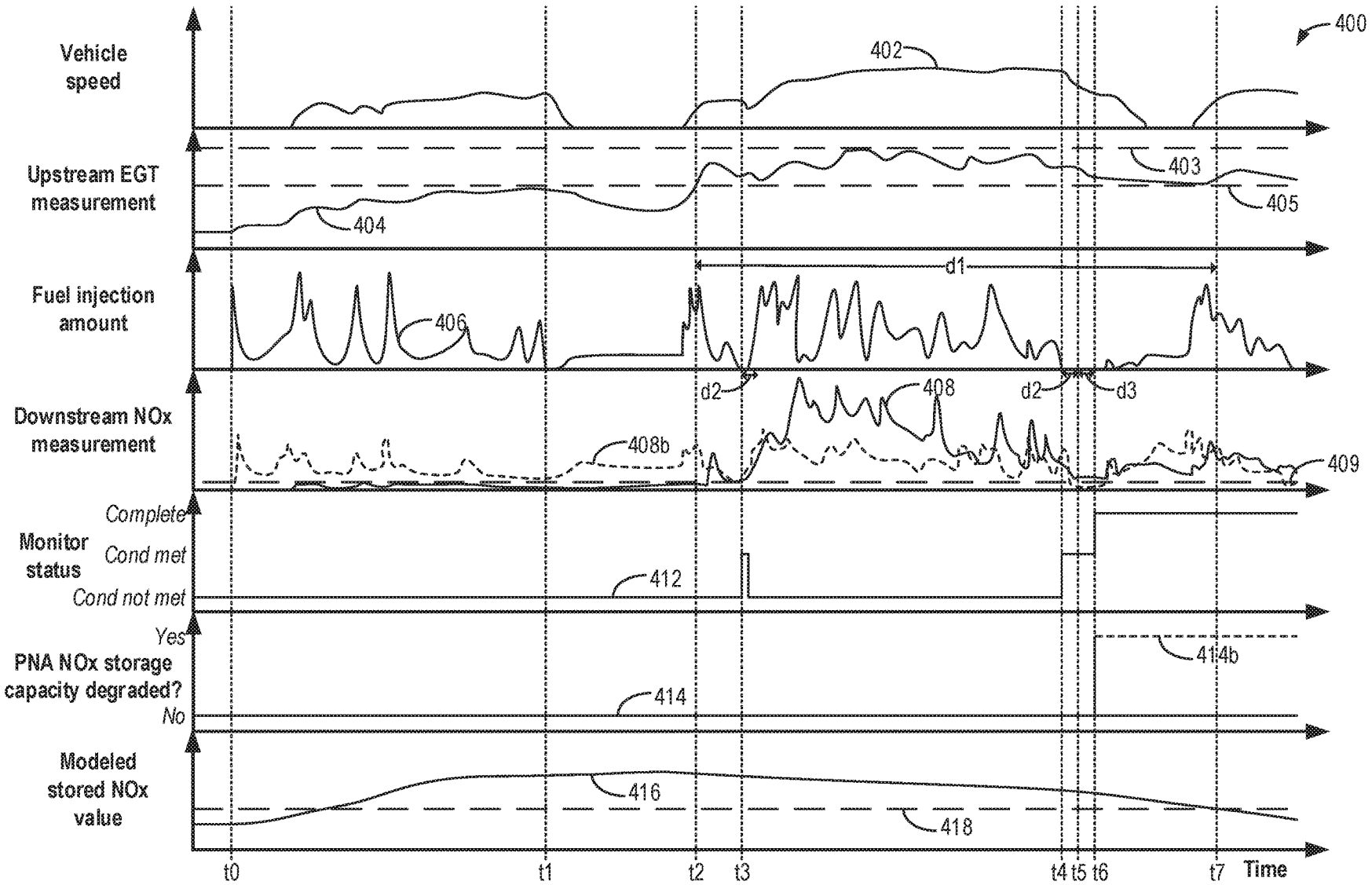
FIG. 4 is a prophetic example timeline for performing the NOx storage capacity monitor during vehicle operation.

FIGS. 3A and 3B illustrate how an average EGT value measured upstream of a PNA (e.g., as measured by exhaust gas temperature sensor 158 upstream of PNA 70 of FIG. 1) and vehicle drive time (e.g., engine operating time), which may be accounted for by the NOx storage model, affect the ability of the PNA NOx storage capacity monitor described with respect to FIG. 2 to distinguish between a PNA with a non-degraded NOx storage capacity and a PNA with a degraded NOx storage capacity. FIGS. 3A and 3B show scatterplots 300 and 350, respectively, of average NOx values measured downstream of the PNA (the vertical axis), such as measured by NOx sensor 133 of FIG. 1, plotted with respect to the average EGT value measured upstream of the PNA (the horizontal axis). Specifically, scatterplot 300 of FIG. 3A includes data gathered while the modeled stored NOx value greater than a threshold stored NOx value and the EGT is within the threshold temperature range (e.g., as defined at 204 of FIG. 2). For example, with the modeled stored NOx value greater than the threshold stored NOx value, sufficient NOx may have been stored prior to the EGT entering the threshold range, and the vehicle drive time while operating with the EGT within the threshold range may be relatively short before performing the monitor. Conversely, scatterplot 350 of FIG. 3B includes data gathered while the modeled stored NOx value is less than the threshold and/or the EGT has exceeded the upper threshold temperature (e.g., as also defined at 204 of FIG. 2). For example, with the modeled stored NOx value less than the threshold, a low amount of NOx may have been stored prior to the EGT entering the threshold range and/or the vehicle drive time while operating with the EGT within the threshold range may be relatively long before performing the monitor. In scatterplots 300 and 350, squares 302 correspond to data points from PNAs with a non-degraded NOx storage capacity, and circles 304 correspond to data points from PNAs with a degraded NOx storage capacity. Furthermore, a dashed line 306 represents the monitor threshold (e.g., as defined at 222 of FIG. 2). Although the monitor threshold is shown as a constant value in the example of FIGS. 3A and 3B, note that in other examples, the monitor threshold varies with the average EGT value.

Turning first to scatterplot 300 of FIG. 3A, the inclusion of the modeled stored NOx value being greater than the threshold stored NOx value and the exhaust gas temperature being within the threshold temperature range as entry conditions results in all of the data points from the non-degraded PNAs (squares 302) being above the monitor threshold (dashed line 306) and all of the data points from the degraded PNAs (circles 304) being below the monitor threshold (dashed line 306). Therefore, complete separation between the non-degraded PNAs and the degraded PNAs is achieved, and the monitor threshold reliably distinguishes the non-degraded PNAs from the degraded PNAs.

In contrast, scatterplot 350 of FIG. 3B includes data points from the non-degraded PNAs (squares 302) below the monitor threshold (dashed line 306), such as overlapping with data points from the degraded PNAs (circles 304). For example, due to a relatively low amount of stored NOx, a long drive time with the PNA in a NOx-releasing condition, and/or the high exhaust gas temperature upstream of the PNA, by the time the monitor is performed, substantially all of the NOx has already been released from the non-degraded PNAs with data points below the monitor threshold. Therefore, complete separation between the non-degraded PNAs and the degraded PNAs is not achieved, and the monitor threshold does not reliably distinguish the non-degraded PNAs and the degraded PNAs. As demonstrated by scatterplot 350 of FIG. 3B, if the modeled stored NOx value being greater than the threshold stored NOx value and the exhaust gas temperature remaining less than the upper threshold temperature are not included as entry conditions for the PNA NOx storage capacity monitor, PNA NOx storage capacity degradation may be falsely detected.

Next, FIG. 4 shows an example timeline 400 for determining a NOx storage capacity status (e.g., degraded or non-degraded) of a PNA included in an exhaust after-treatment system of a vehicle (e.g., PNA 70 of FIG. 1) using NOx measurements from a single NOx sensor downstream of the PNA (e.g., NOx sensor 133 of FIG. 1) and exhaust gas temperature measurements from an exhaust gas temperature sensor upstream of the PNA (e.g., exhaust gas temperature sensor 158 of FIG. 1). For example, the NOx storage capacity status of the PNA may be determined by a controller (e.g., controller 12 of FIG. 1) using a NOx storage capacity monitor, such as according to method 200 of FIG. 2. Vehicle speed is shown in plot 402, the upstream exhaust gas temperature measurement is shown in plot 404, an amount of fuel injected into an engine of the vehicle is shown in plot 406, the downstream NOx measurement for a PNA with a non-degraded NOx storage capacity is shown in plot 408, an indication of the monitor status is shown in plot 412, an indication of whether the PNA NOx storage capacity is degraded is shown in plot 414, and a modeled stored NOx value is shown in plot 416. For comparison, the downstream NOx measurement for a PNA with a degraded NOx storage capacity is shown in dashed plot 408*b*, and the corresponding indication of degradation is shown in dashed segment 414*b*. For all of the above, the horizontal axis represents time, with time increasing along the horizontal axis from left to right. The vertical axis represents each labeled parameter. For plots 402, 404, 406, 408, and 416, a value of the labeled parameter increases along the vertical axis from bottom to top. For plot 412, the vertical axis represents whether the conditions for performing the monitor are not met ("cond not met"), met ("cond met"), or whether the monitor is complete ("complete"), as labeled. For plot 414, the vertical axis represents whether the PNA NOx storage capacity is degraded ("yes") or non-degraded ("no"), as labeled. Furthermore, an upper threshold EGT for performing the monitor is indicated by dashed line 403, a lower threshold EGT for performing the monitor is indicated by dashed line 405, a monitor threshold is indicated by dashed line 409, and a lower modeled stored NOx value threshold for performing the monitor is indicated by dashed line 418. Although the monitor threshold is shown throughout timeline 400 for clarity, note that the monitor threshold may only be determined and used while the PNA NOx storage capacity monitor is being performed, as described above with respect to FIG. 2.

At time t0, the vehicle is keyed on, and a non-zero amount of fuel is supplied to the engine between time t0 and time t1 (plot 406). As the engine is operated, the exhaust gas temperature measured upstream of the PNA begins to increase (plot 404) but stays below the lower threshold temperature (dashed line 405). With the exhaust gas temperature upstream of the PNA below the lower threshold temperature (dashed line 405), NOx produced through combustion is primarily stored by the PNA, and the modeled stored NOx value increases (plot 416) from a non-zero value stored in non-volatile memory (e.g., the modeled stored NOx value when the vehicle was keyed off). Because conditions promote NOx storage by the PNA, an amount of NOx measured downstream of the PNA is low (plot 408). However, in the case of a PNA with degraded NOx storage capacity, the amount of NOx measured downstream of the PNA is higher (dashed plot 408*b*), as the NOx is not appreciably stored by the degraded PNA.

At time t1, the vehicle decelerates (plot 402) and enters an overrun event, and no fuel is injected into the engine (plot 406). However, the conditions for entering the PNA NOx storage capacity monitor are not met (plot 412), as the upstream EGT measurement (plot 404) remains below the lower threshold temperature (dashed line 405). With the EGT below the lower threshold temperature, the PNA continues to store NOx and not release the NOx, and the downstream NOx measurement remains low (plot 408). As such, despite an overrun event being present, the monitor is not performed. Furthermore, the downstream NOx measurement remains higher for the PNA with the degraded NOx storage capacity (dashed plot 408*b*).

At time t2, the EGT measured upstream of the PNA (plot 404) reaches the lower threshold temperature (dashed line 405). As such, the EGT is within a threshold temperature range for performing the PNA NOx storage capacity monitor. Further, the modeled stored NOx value is greater than the lower modeled stored NOx value threshold (dashed line 418), indicating that a non-degraded PNA would have a sufficient amount of NOx stored to be distinguished from a degraded PNA by the monitor. However, the conditions for entering the PNA NOx storage capacity monitor are not yet met (plot 412), as a non-zero amount of fuel is supplied to the engine (plot 406), showing that an overrun event is not present. Further, in some examples, the controller may determine a threshold duration d1 for completing the monitor in response to the EGT surpassing the lower threshold temperature (dashed line 405). The threshold duration d1 may be based on the modeled stored NOx value and the upstream EGT measurement, as described above with respect to FIG. 2, and may be adjusted as engine operating conditions change.

At time t3, the vehicle decelerates (plot 402) and enters another overrun event, resulting in the fuel injection amount reaching zero (plot 406). The EGT measured upstream of the PNA (plot 404) remains above the lower threshold temperature (dashed line 405) and below the upper threshold temperature (dashed line 403), indicating a temperature condition that facilitates a release of stored NOx. Furthermore, the modeled stored NOx value (plot 416) remains above the lower modeled stored NOx value threshold (dashed line 418). Accordingly, the threshold duration d1 has not yet elapsed. Therefore, the entry conditions for the PNA NOx storage capacity monitor are met at time t3 (plot 412), and the controller waits for an overrun delay having a duration d2. However, shortly after time t3 and before the overrun delay duration d2 has elapsed, fuel injection is resumed (plot 406) to accelerate the vehicle (plot 402). In response to the non-zero fuel injection amount, the conditions for performing the PNA NOx storage capacity monitor are no longer met (plot 412), and the monitor is not completed. Furthermore, because a duration of the overrun event did not surpass the duration d2 of the overrun delay, no upstream EGT measurements or downstream NOx values during the overrun event were recorded and stored in a memory of the controller.

Between time t3 and time t4, the NOx measurement downstream of the non-degraded PNA (plot 408) is much higher than prior to time t3. With the EGT upstream of the PNA above the lower threshold temperature, stored NOx is released by the PNA, and the modeled stored NOx value (plot 416) decreases. Furthermore, the amount of NOx measured downstream of the non-degraded PNA (plot 408) is generally higher than the amount of NOx measured downstream of the degraded PNA (dashed plot 408*b*) due to the fact that the degraded PNA does not have an appreciable amount of stored NOx to release. Therefore, the NOx measured downstream of the degraded PNA (dashed plot 408*b*) is substantially all from the exhaust stream exiting the engine, whereas the amount of NOx measured downstream of the non-degraded PNA (plot 408) is a mixture of stored NOx being released and NOx from the exhaust stream exiting the engine.

At time t4, the vehicle decelerates again (plot 402) and enters another overrun event, and the fuel injection amount reaches zero (plot 406). The EGT measured upstream of the PNA (plot 404) remains above the lower threshold temperature (dashed line 405) and below the upper threshold temperature (dashed line 403), and the modeled stored NOx value (plot 416) remains above the lower modeled stored NOx value threshold (dashed line 418). Further, the vehicle drive time remains less than the threshold duration d1. Therefore, the entry conditions for the PNA NOx storage capacity monitor are met at time t4 (plot 412), and the controller waits for the overrun delay duration d2. During the overrun delay, the amount of NOx measured downstream of the non-degraded PNA (plot 408) decreases as exhaust gas that contains NOx is flushed out of the exhaust system and is replaced by fresh air. Therefore, the remaining NOx measured is from NOx released from the PNA. The amount of NOx measured downstream of the degraded PNA (plot 408*b*) also decreases. Further, the amount of NOx measured downstream of the degraded PNA (plot 408*b*) decreases to a larger extent than the amount NOx measured downstream of the non-degraded PNA (plot 408) because NOx is not appreciably released from the PNA with the degraded NOx storage capacity.

At time t5, the overrun delay duration d2 is complete. In response, the upstream EGT measurements (plot 404) and the downstream NOx measurements (plot 408 for the non-degraded PNA and dashed plot 408*b* for the degraded PNA) are obtained and recorded. Furthermore, the controller records the upstream EGT measurements and the downstream NOx measurements for a duration d3 so that EGT and NOx measurements will not be obtained past the duration d3 even if the overrun event continues. As described above with respect to method 200 of FIG. 2, the duration d3 helps avoid depletion of the stored NOx during the PNA NOx storage capacity monitor.

At time t6, the duration d3 is complete. Even though the fuel injection amount remains at zero (plot 406), in response to the duration d3 elapsing, the controller stops storing the upstream EGT measurements and the downstream NOx measurements. The EGT measurement remained between the lower threshold temperature (dashed line 405) and the upper threshold temperature (dashed line 403) during the duration d3. Furthermore, a sufficient number of NOx measurements were obtained for completing the monitor, such as greater than a threshold number of measurements (not shown). In response, the monitor is marked complete at time t6 (plot 412). Because an average NOx measurement downstream of the non-degraded PNA (plot 408) recorded between time t5 and time t6 is greater than the monitor threshold (dashed line 409), degradation of the PNA NOx storage capacity is not indicated (plot 414). In contrast, because an average NOx measurement downstream of the degraded PNA (dashed plot 408*b*) recorded between time t5 and time t6 is less than the monitor threshold (dashed line 409), degradation of the PNA NOx storage capacity is indicated at time t6 (dashed segment 414*b*).

At time t7, the modeled stored NOx value (plot 416) decreases below the lower modeled stored NOx value threshold (dashed line 418), and the threshold duration d1 elapses. Therefore, if the monitor had not been completed at time t6, the monitor would not be able to run again until after engine operating conditions facilitate NOx storage, such as operation with low exhaust gas temperatures upstream of the PNA (e.g., less than the threshold temperature described above at 202 of FIG. 2), and the modeled stored NOx value increases above the lower modeled stored NOx value threshold (dashed line 418).

In this way, a PNA NOx storage capacity monitor is able to more clearly distinguish between a non-degraded PNA and a degraded PNA via NOx release, independent of a NOx storage measurement. By diagnosing the NOx storage capacity of the PNA based on the amount of NOx released by the PNA, an upstream NOx sensor may be omitted, reducing vehicle costs and potential points of degradation. Furthermore, a downstream NOx sensor may already be included for dosing reductant at a downstream SCR catalyst, and thus, no NOx sensor may be included solely for the PNA NOx storage capacity monitor. Additionally, by determining degradation of the PNA NOx storage capacity based on the amount of NOx released by the PNA alone, potentially inaccurate models of NOx produced through combustion are not used for determining a monitor threshold, increasing an accuracy of the determination.

The technical effect of diagnosing a degraded NOx storage capacity of a passive NOx adsorption catalyst based on an amount of NOx released from the passive NOx adsorption catalyst via a single, downstream NOx sensor is that an upstream NOx sensor may be omitted without reducing a reliability of the diagnosing.

As one example, a method comprises: indicating degradation of a passive NOx adsorption catalyst (PNA) based on an amount of nitrogen oxides (NOx) measured downstream of the PNA during an overrun event that occurs after an exhaust gas temperature measured upstream of the PNA reaches a lower threshold temperature and while a modeled stored NOx value is greater than a lower threshold value. In the preceding example, additionally or optionally, the indicating degradation of the passive NOx adsorption catalyst is responsive to the exhaust gas temperature measured upstream of the PNA being within a threshold temperature range defined by the lower threshold temperature and an upper threshold temperature, and the modeled stored NOx value is based in part on the exhaust gas temperature measured upstream of the PNA. In any or all of the preceding examples, additionally or optionally, the amount of NOx measured downstream of the PNA during the overrun event is an average amount of NOx calculated from a plurality of NOx measurements recorded after an overrun delay. In any or all of the preceding examples, additionally or optionally, a duration of the overrun delay is determined based on at least one of engine speed and engine airflow. In any or all of the preceding examples, additionally or optionally, the plurality of NOx measurements are recorded during a single overrun event or recorded during a plurality of overrun events. In any or all of the preceding examples, additionally or optionally, the indicating degradation of the PNA based on the amount of NOx measured downstream of the PNA during the overrun event is responsive to the amount of NOx being less than a threshold amount of NOx. In any or all of the preceding examples, additionally or optionally, the threshold amount of NOx is determined based on an average exhaust gas temperature measured upstream of the PNA during the overrun event and is independent of an amount of NOx input into the PNA. In any or all of the preceding examples, the method additionally or optionally further comprises, responsive to the indicating degradation of the PNA, adjusting an engine operating parameter, including one or more of an exhaust gas recirculation amount and a fuel injection timing. In any or all of the preceding examples, the method additionally or optionally further comprises operating in the overrun event, including stopping fuel injection to the engine, after the exhaust gas temperature measured upstream of the PNA reaches the lower threshold temperature and while the modeled stored NOx value is greater than the lower threshold value, and during the operating in the overrun event: measuring the amount of NOx downstream of the PNA; and indicating degradation of the PNA based on the measured amount of NOx.

As another example, a method comprises: operating an engine in a first condition while an exhaust gas temperature is above a lower threshold temperature and below an upper threshold temperature and a modeled stored NOx value is above a lower threshold value; and in response to operating the engine in the first condition: measuring an amount of NOx released by a passive NOx adsorption catalyst (PNA); and indicating a degraded NOx storage capacity or a non-degraded NOx storage capacity of the PNA based on the measured amount of NOx. In the preceding example, additionally or optionally, the measuring the amount of NOx released by the PNA is via a NOx sensor positioned downstream of the PNA and during an overrun event, and the indicating the degraded NOx storage capacity or the non-degraded NOx storage capacity based on the measured amount of NOx comprises: indicating the degraded NOx storage capacity in response to the measured amount of NOx being less than a threshold; and indicating the non-degraded NOx storage capacity in response to the measured amount of NOx being greater than the threshold. In any or all of the preceding examples, additionally or optionally, the threshold is determined based on the exhaust gas temperature during the overrun event. In any or all of the preceding examples, the method additionally or optionally further comprises, responsive to the indicating the degraded NOx storage capacity, adjusting an operating parameter of the engine, including one or more of an engine dilution, a timing of fuel injections to the engine, and a number of the fuel injections, during a subsequent start of the engine; and responsive to the indicating the non-degraded NOx storage capacity, maintaining the operating parameter of the engine during the subsequent start of the engine. In any or all of the preceding examples, the method additionally or optionally further comprises, in response to at least one the exhaust gas temperature decreasing below the lower threshold temperature, the exhaust gas temperature exceeding the upper threshold temperature, and the modeled stored NOx value decreasing below the lower threshold value, operating the engine in a second condition where the degraded NOx storage capacity or the non-degraded NOx storage capacity is not indicated.

As another example, a system comprises: an engine configured to combust fuel and air; a passive NOx adsorption catalyst coupled to an exhaust passage of the engine, the passive NOx adsorption catalyst having a NOx storage capacity; and a controller storing executable instructions in non-transitory memory that, when executed, cause the controller to: measure an amount of NOx released from the passive NOx adsorption catalyst in response to an exhaust gas temperature being within a threshold temperature range, a modeled stored NOx value being greater than a lower threshold value, and the engine operating during a fuel cut condition where no fuel is injected into the engine; and indicate degradation of the passive NOx adsorption catalyst in response to the measured amount of NOx released being below a threshold NOx value. In the preceding example, the system additionally or optionally further comprises a selective catalytic reduction (SCR) catalyst coupled to the exhaust passage downstream of the passive NOx adsorption catalyst; only one NOx sensor arranged in the exhaust passage, the only one NOx sensor positioned downstream of the passive NOx adsorption catalyst and upstream of the SCR catalyst; and an exhaust gas temperature sensor coupled upstream of the passive NOx adsorption catalyst; and wherein the instructions that cause the controller to measure the amount of NOx released from the passive NOx adsorption catalyst in response to the exhaust gas temperature being within the threshold temperature range, the modeled stored NOx value being greater than the lower threshold value, and the engine operating during the fuel cut condition where no fuel is injected into the engine include further instructions stored in non-transitory memory that, when executed, cause the controller to: record NOx measurements from an output of the only one NOx sensor and exhaust gas temperature measurements from an output of the exhaust gas temperature sensor after a first threshold duration has elapsed since a beginning of the fuel cut condition; stop recording the NOx measurements and the exhaust gas temperature measurements in response to a second threshold duration elapsing during the fuel cut condition or in response to an end of the fuel cut condition; calculate an average NOx value from the recorded NOx measurements and an average exhaust gas temperature value from the recorded exhaust gas temperature measurements; and determine the threshold NOx value based on the average exhaust gas temperature value. In any or all of the preceding examples, additionally or optionally, the instructions that cause the controller to indicate degradation of the passive NOx adsorption catalyst in response to the measured amount of NOx released being below the threshold NOx value include further instructions stored in non-transitory memory that, when executed, cause the controller to: indicate degradation of the NOx storage capacity of the passive NOx absorption catalyst in response to the average NOx value being below the threshold NOx value; and indicate no degradation of the NOx storage capacity of the passive NOx adsorption catalyst in response to the average NOx value being above the threshold NOx value. In any or all of the preceding examples, additionally or optionally, the first threshold duration is adjusted based on a speed of the engine. In any or all of the preceding examples, the system additionally or optionally further comprises an exhaust gas recirculation (EGR) system including an EGR valve disposed within an EGR passage that couples the exhaust passage to an intake of the engine, and wherein the controller stores further executable instructions in non-transitory memory that, when executed, cause the controller to: adjust a position of the EGR valve during a subsequent cold start of the engine in response to indicating degradation of the passive NOx adsorption catalyst. In any or all of the preceding examples, the system additionally or optionally further comprises a fuel injector directly coupled to a cylinder of the engine, and wherein the controller stores further executable instructions in non-transitory memory that, when executed, cause the controller to: adjust a timing of actuating the fuel injector to deliver fuel to the cylinder of the engine in response to indicating degradation of the passive NOx adsorption catalyst.

In another representation, a method comprises: after an engine cold start and prior to an exhaust gas temperature exceeding an upper threshold temperature, differentiating between a degraded NOx storage capacity and a non-degraded NOx storage capacity of a passive NOx adsorption catalyst (PNA) based on an amount of NOx released by the PNA after the exhaust gas temperature surpasses a lower threshold temperature; and adjusting one or more engine operating parameters during a subsequent engine cold start in response to the degraded NOx storage capacity. In the preceding example, additionally or optionally, the differentiating between the degraded NOx storage capacity and the non-degraded NOx storage capacity is while operating in an overrun condition. In any or all of the preceding examples, additionally or optionally, operating in the overrun event includes discontinuing fuel injection to the engine in response to a vehicle deceleration event. In any or all of the preceding examples, additionally or optionally, the amount of NOx released by the PNA is measured by a NOx sensor positioned downstream of the PNA and upstream of a selective catalytic reduction catalyst. In any or all of the preceding examples, additionally or optionally, a threshold for the differentiating between the degraded NOx storage capacity and the non-degraded NOx storage capacity of the PNA is independent of a measured or modeled amount of NOx input into the PNA.

In another further representation, a method, comprises: indicating degradation of a passive NOx adsorption catalyst (PNA) based on an amount of nitrogen oxides (NOx) measured downstream of the PNA relative to a threshold amount of NOx, the threshold amount of NOx independent of an amount of NOx input into the PNA. In the preceding example, additionally or optionally, the amount of NOx measured downstream of the PNA is measured during an overrun event. In any or all of the preceding examples, additionally or optionally, the amount of NOx measured downstream of the PNA is measured responsive to an exhaust gas temperature measured upstream of the PNA being within a threshold temperature range. In any or all of the preceding examples, additionally or optionally, the amount of NOx measured downstream of the PNA is measured responsive to a modeled stored NOx value being greater than a lower threshold stored NOx value. In any or all of the preceding examples, additionally or optionally, the threshold amount of NOx is determined based on an average exhaust gas temperature measured upstream of the PNA during the overrun event. In any or all of the preceding examples, additionally or optionally, the modeled stored NOx value is determined using a NOx storage model. In any or all of the preceding examples, additionally or optionally, the NOx storage model increases the modeled stored NOx value during conditions that facilitate NOx storage by the PNA and decreases the modeled stored NOx value during conditions that facilitate NOx release by the PNA. In any or all of the preceding examples, additionally or optionally, the conditions that facilitate NOx storage by the PNA include operating with the exhaust gas temperature measured upstream of the PNA less than a threshold temperature. In any or all of the preceding examples, additionally or optionally, the conditions that facilitate NOx release by the PNA include operating with the exhaust gas temperature measured upstream of the PNA greater than the threshold temperature. In any or all of the preceding examples, additionally or optionally, indicating degradation of the PNA based on the amount of NOx measured downstream of the PNA relative to the threshold amount of NOx includes: indicating degradation responsive to the amount of NOx measured downstream of the PNA being less than the threshold amount of NOx; and not indicating degradation responsive to the amount of NOx measured downstream of the PNA being greater than the threshold amount of NOx.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

indicating degradation of a passive NOx adsorption catalyst (PNA) based on an amount of nitrogen oxides (NOx) measured downstream of the PNA during an overrun event that occurs after an exhaust gas temperature measured upstream of the PNA reaches a lower threshold temperature and while a modeled stored NOx value is greater than a lower threshold value.

2. The method of claim 1, wherein the indicating degradation of the PNA is responsive to the exhaust gas temperature measured upstream of the PNA being within a threshold temperature range defined by the lower threshold temperature and an upper threshold temperature, and wherein the modeled stored NOx value is based in part on the exhaust gas temperature measured upstream of the PNA.

3. The method of claim 1, wherein the amount of NOx measured downstream of the PNA during the overrun event is an average amount of NOx calculated from a plurality of NOx measurements recorded after an overrun delay.

4. The method of claim 3, wherein a duration of the overrun delay is determined based on at least one of engine speed and engine airflow.

5. The method of claim 3, wherein the plurality of NOx measurements are recorded during a single overrun event or recorded during a plurality of overrun events.

6. The method of claim 1, wherein the indicating degradation of the PNA based on the amount of NOx measured downstream of the PNA during the overrun event is responsive to the amount of NOx being less than a threshold amount of NOx.

7. The method of claim 6, wherein the threshold amount of NOx is determined based on an average exhaust gas temperature measured upstream of the PNA during the overrun event and is independent of an amount of NOx input into the PNA.

8. The method of claim 1, further comprising:

responsive to the indicating degradation of the PNA, adjusting an engine operating parameter, including one or more of an exhaust gas recirculation amount and a fuel injection timing.

9. The method of claim 1, further comprising operating in the overrun event, including stopping fuel injection to an engine, after the exhaust gas temperature measured upstream of the PNA reaches the lower threshold temperature and while the modeled stored NOx value is greater than the lower threshold value, and during the operating in the overrun event:

measuring the amount of NOx downstream of the PNA; and indicating degradation of the PNA based on the measured amount of NOx.

10. A method, comprising:

operating an engine in a first condition while an exhaust gas temperature is above a lower threshold temperature and below an upper threshold temperature and a modeled stored NOx value is above a lower threshold value; and in response to operating the engine in the first condition:

measuring an amount of NOx released by a passive NOx adsorption catalyst (PNA); and indicating a degraded NOx storage capacity or a non-degraded NOx storage capacity of the PNA based on the measured amount of NOx, wherein the measuring the amount of NOx released by the PNA is via a NOx sensor positioned downstream of the PNA and during an overrun event, and the indicating the degraded NOx storage capacity or the non-degraded NOx storage capacity based on the measured amount of NOx comprises:

indicating the degraded NOx storage capacity in response to the measured amount of NOx being less than a threshold; and indicating the non-degraded NOx storage capacity in response to the measured amount of NOx being greater than the threshold.

11. The method of claim 10, wherein the threshold is determined based on the exhaust gas temperature during the overrun event.

12. The method of claim 10, further comprising:

responsive to the indicating the degraded NOx storage capacity, adjusting an operating parameter of the engine, including one or more of an engine dilution, a timing of fuel injections to the engine, and a number of the fuel injections, during a subsequent start of the engine; and responsive to the indicating the non-degraded NOx storage capacity, maintaining the operating parameter of the engine during the subsequent start of the engine.

13. The method of claim 10, further comprising:

in response to at least one of the exhaust gas temperature decreasing below the lower threshold temperature, the exhaust gas temperature exceeding the upper threshold temperature, and the modeled stored NOx value decreasing below the lower threshold value, operating the engine in a second condition where the degraded NOx storage capacity or the non-degraded NOx storage capacity is not indicated.

14. A system, comprising:

an engine configured to combust fuel and air;

a passive NOx adsorption catalyst coupled to an exhaust passage of the engine, the passive NOx adsorption catalyst having a NOx storage capacity; and a controller storing executable instructions in non-transitory memory that, when executed, cause the controller to:

measure an amount of NOx released from the passive NOx adsorption catalyst in response to an exhaust gas temperature being within a threshold temperature range, a modeled stored NOx value being greater than a lower threshold value, and the engine operating during a fuel cut condition where no fuel is injected into the engine; and indicate degradation of the passive NOx adsorption catalyst in response to the measured amount of NOx released being below a threshold NOx value.

15. The system of claim 14, further comprising:

a selective catalytic reduction (SCR) catalyst coupled to the exhaust passage downstream of the passive NOx adsorption catalyst;

only one NOx sensor arranged in the exhaust passage, the only one NOx sensor positioned downstream of the passive NOx adsorption catalyst and upstream of the SCR catalyst; and an exhaust gas temperature sensor coupled upstream of the passive NOx adsorption catalyst;

wherein the instructions that cause the controller to measure the amount of NOx released from the passive NOx adsorption catalyst in response to the exhaust gas temperature being within the threshold temperature range, the modeled stored NOx value being greater than the lower threshold value, and the engine operating during the fuel cut condition where no fuel is injected into the engine include further instructions stored in non-transitory memory that, when executed, cause the controller to:

record NOx measurements from an output of the only one NOx sensor and exhaust gas temperature measurements from an output of the exhaust gas temperature sensor after a first threshold duration has elapsed since a beginning of the fuel cut condition;

stop recording the NOx measurements and the exhaust gas temperature measurements in response to a second threshold duration elapsing during the fuel cut condition or in response to an end of the fuel cut condition;

calculate an average NOx value from the recorded NOx measurements and an average exhaust gas temperature value from the recorded exhaust gas temperature measurements; and determine the threshold NOx value based on the average exhaust gas temperature value.

16. The system of claim 15, wherein the instructions that cause the controller to indicate degradation of the passive NOx adsorption catalyst in response to the measured amount of NOx released being below the threshold NOx value include further instructions stored in non-transitory memory that, when executed, cause the controller to:

indicate degradation of the NOx storage capacity of the passive NOx absorption catalyst in response to the average NOx value being below the threshold NOx value; and indicate no degradation of the NOx storage capacity of the passive NOx adsorption catalyst in response to the average NOx value being above the threshold NOx value.

17. The system of claim 15, wherein the first threshold duration is adjusted based on a speed of the engine.

18. The system of claim 14, further comprising an exhaust gas recirculation (EGR) system, including an EGR valve disposed within an EGR passage that couples the exhaust passage to an intake of the engine, and wherein the controller stores further executable instructions in non-transitory memory that, when executed, cause the controller to:

adjust a position of the EGR valve during a subsequent cold start of the engine in response to indicating degradation of the passive NOx adsorption catalyst.

19. The system of claim 14, further comprising a fuel injector directly coupled to a cylinder of the engine, and wherein the controller stores further executable instructions in non-transitory memory that, when executed, cause the controller to:

adjust a timing of actuating the fuel injector to deliver fuel to the cylinder of the engine in response to indicating degradation of the passive NOx adsorption catalyst.

* * * * *